US010921723B2

(12) United States Patent
Takizawa et al.

(10) Patent No.: US 10,921,723 B2
(45) Date of Patent: Feb. 16, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kumiko Takizawa, Saitama (JP); Tsuyoshi Shimada, Kashiwa (JP); Takanori Ueno, Nagareyama (JP); Ikuyo Kuroiwa, Tokyo (JP); Haruhiko Mitsuda, Nagareyama (JP); Kan Tanabe, Matsudo (JP); Tatsuya Ikezue, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/597,152

(22) Filed: Oct. 9, 2019

(65) Prior Publication Data

US 2020/0133147 A1 Apr. 30, 2020

(30) Foreign Application Priority Data

Oct. 25, 2018 (JP) ..... 2018-201289

(51) Int. Cl.
*G03G 5/00* (2006.01)
*G03G 5/14* (2006.01)
(Continued)

(52) U.S. Cl.
CPC ..... *G03G 5/144* (2013.01); *G03G 5/0542* (2013.01); *G03G 5/0564* (2013.01);
(Continued)

(58) Field of Classification Search
CPC .... G03G 5/144; G03G 5/0542; G03G 5/0564; G03G 5/0614
(Continued)

(56) References Cited

U.S. PATENT DOCUMENTS 5,198,685 A 5/1993 Kitani et al.
5,393,628 A 2/1995 Ikezue et al.
(Continued)

FOREIGN PATENT DOCUMENTS

JP 2002-169359 6/2002
JP 2005-242155 9/2005
(Continued)

OTHER PUBLICATIONS

U.S. Appl. No. 16/507,220, Ryosuke Tsuruga, filed Jul. 10, 2019.
(Continued)

*Primary Examiner* — Mark A Chapman
(74) *Attorney, Agent, or Firm* — Venable LLP

(57) ABSTRACT

Provided is an electrophotographic photosensitive member that can achieve both of abrasion resistance and the suppression of a ghost. The electrophotographic photosensitive member includes: a support; an undercoat layer; a charge-generating layer; and a charge-transporting layer, the undercoat layer, the charge-generating layer, and the charge-transporting layer being arranged in the stated order on the support, wherein the charge-transporting layer includes a charge-transporting substance, and a polymer containing a structure represented by the following general formula (1) and a structure represented by the following general formula (2), wherein the charge-generating layer includes a phtha-
(Continued)

locyanine crystal and a binder resin, and wherein the undercoat layer includes strontium titanate particles and a binder resin.

General formula (1)

General formula (2)

13 Claims, 2 Drawing Sheets

(51) Int. Cl.

| | |
|---|---|
| ***G03G 5/06*** | (2006.01) |
| ***G03G 5/05*** | (2006.01) |
| ***G03G 15/00*** | (2006.01) |
| ***G03G 21/18*** | (2006.01) |

(52) U.S. Cl.
CPC ..... *G03G 5/0614* (2013.01); *G03G 5/0696* (2013.01); *G03G 15/75* (2013.01); *G03G 21/18* (2013.01)

(58) Field of Classification Search
USPC ..... 430/59.6
See application file for complete search history.

(56) References Cited

U.S. PATENT DOCUMENTS

| | | | |
|---|---|---|---|
| 5,485,250 | A | 1/1996 | Kashimura et al. |
| 5,504,558 | A | 4/1996 | Ikezue |
| 5,994,011 | A | 11/1999 | Kashimura et al. |
| 6,183,922 | B1 | 2/2001 | Takai et al. |
| 6,218,063 | B1 | 4/2001 | Tanaka et al. |
| 6,335,132 | B1 | 1/2002 | Tanaka et al. |
| 6,806,009 | B2 | 10/2004 | Tanaka et al. |
| 6,815,135 | B2 | 11/2004 | Morikawa et al. |
| 6,835,512 | B2 | 12/2004 | Morikawa et al. |
| 6,913,862 | B2 | 7/2005 | Nakata et al. |
| 6,998,210 | B2 | 2/2006 | Yoshimura et al. |
| 7,022,446 | B2 | 4/2006 | Yoshimura et al. |
| 7,078,140 | B2 | 7/2006 | Yoshimura et al. |
| 7,186,489 | B2 | 3/2007 | Uematsu et al. |
| 7,226,711 | B2 | 6/2007 | Amamiya et al. |
| 7,534,534 | B2 | 5/2009 | Nakata et al. |
| 7,813,675 | B2 | 10/2010 | Tanabe et al. |
| 9,599,917 | B2 | 3/2017 | Okuda et al. |
| 9,766,561 | B2 | 9/2017 | Takahashi et al. |
| 9,983,490 | B2 | 5/2018 | Shimada et al. |
| 10,101,678 | B2 | 10/2018 | Kawasaki |
| 10,216,105 | B2 | 2/2019 | Kaku et al. |
| 10,241,429 | B2 | 5/2019 | Shimada et al. |
| 10,338,486 | B2 | 7/2019 | Abe et al. |
| 10,353,340 | B2 | 7/2019 | Kuroiwa et al. |
| 10,488,770 | B2 | 11/2019 | Kuroiwa et al. |
| 2018/0314188 | A1 | 11/2018 | Takeuchi et al. |
| 2019/0072865 | A1 | 3/2019 | Ohira et al. |
| 2019/0369513 | A1 | 12/2019 | Ueno et al. |

FOREIGN PATENT DOCUMENTS

| | | |
|---|---|---|
| JP | 2006-011485 | 1/2006 |
| JP | 2018-049148 | 3/2018 |
| JP | 2018-063367 | 4/2018 |
| JP | 2018-141972 | 9/2018 |

OTHER PUBLICATIONS

U.S. Appl. No. 16/601,994, Tsuyoshi Shimada, filed Oct. 15, 2019.
U.S. Appl. No. 16/654,467, Tatsuya Ikezue, filed Oct. 16, 2019.
U.S. Appl. No. 16/658,591, Takanori Ueno, filed Oct. 21, 2019.

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

An electrophotographic photosensitive member obtained by laminating an undercoat layer, a charge-generating layer, and a charge-transporting layer in the stated order on a support has been used as an electrophotographic photosensitive member to be used in an electrophotographic apparatus.

A polycarbonate resin has heretofore been frequently used as a binder resin for the charge-transporting layer serving as the surface layer of the electrophotographic photosensitive member. In recent years, however, a biphenyl copolymerization-type polycarbonate resin having a relatively high mechanical strength has been proposed for improving the abrasion resistance of the electrophotographic photosensitive member (Japanese Patent Application Laid-Open No. 2018-049148).

SUMMARY OF THE INVENTION

The object is achieved by one aspect of the present disclosure described below. That is, according to one aspect of the present disclosure, there is provided an electrophotographic photosensitive member including: a support; an undercoat layer; a charge-generating layer; and a charge-transporting layer, the undercoat layer, the charge-generating layer, and the charge-transporting layer being arranged in the stated order on the support, wherein the charge-transporting layer includes a charge-transporting substance, and a polymer containing a structure represented by the general formula (1) and a structure represented by the general formula (2), wherein the charge-generating layer includes a phthalocyanine crystal and a binder resin, and wherein the undercoat layer includes strontium titanate particles and a binder resin:

General formula (1)

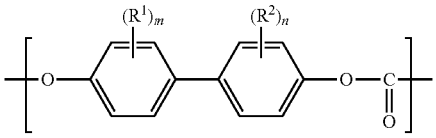

in the general formula (1), $R^1$ and $R^2$ each independently represent a hydrogen atom, a halogen atom, a substituted or unsubstituted alkyl group, or an aryl group, and "m" and "n" each independently represent an integer of 0 or more and 4 or less;

General formula (2)

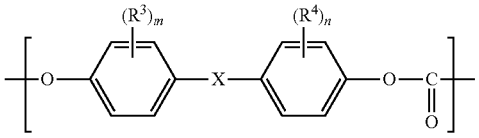

in the general formula (2), $R^3$ and $R^4$ each independently represent a halogen atom, an alkyl group, a cycloalkyl group, or an aryl group, "m" and "n" each independently represent an integer of 0 or more and 4 or less, and X represents a cycloalkylene group, an alkylene group, a phenylene group, a biphenylene group, a naphthylene group, —O—, —S—, —SO—, or —$SO_2$—.

According to one aspect of the present disclosure, there is also provided a process cartridge including: the electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus.

According to one aspect of the present disclosure, there is also provided an electrophotographic apparatus including: the electrophotographic photosensitive member; and at least one unit selected from the group consisting of a charging unit, an exposing unit, a developing unit, and a transferring unit.

Further features of the present disclosure will become apparent from the following description of exemplary embodiments with reference to the attached drawings.

DESCRIPTION OF THE EMBODIMENTS

Figure 1:
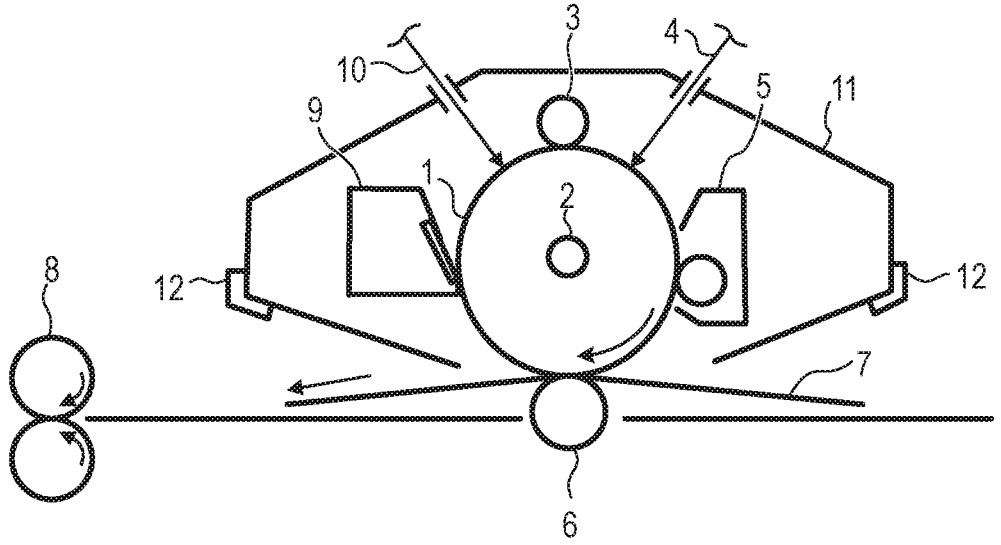
FIG. 1 is a view for illustrating an example of an electrophotographic apparatus including a process cartridge including an electrophotographic photosensitive member according to one aspect of the present disclosure.

An electrophotographic photosensitive member using a polycarbonate resin having a biphenyl skeleton in its charge-transporting layer has involved a problem in that a ghost image in which a light irradiation history at the time of the previous rotation of the electrophotographic photosensitive member appears as a density difference is liable to occur at the time of the output of a halftone image. Along with an improvement in image quality of an electrophotographic apparatus, the alleviation of the ghost image has been desired.

Therefore, it is an object of the present disclosure to provide an electrophotographic photosensitive member that can achieve both of abrasion resistance and the suppression of a ghost.

Now, the present disclosure is described in detail by way of preferred embodiments.

An electrophotographic photosensitive member according to one aspect of the present disclosure includes: a support; an undercoat layer; a charge-generating layer; and a charge-transporting layer, the undercoat layer, the charge-generating layer, and the charge-transporting layer being arranged in the stated order on the support, wherein the charge-transporting layer includes a charge-transporting substance, and a polymer containing a structure represented by the general formula (1) and a structure represented by the general formula (2), wherein the charge-generating layer includes a phthalocyanine crystal and a binder resin, and wherein the undercoat layer includes strontium titanate particles and a binder resin:

General formula (1)

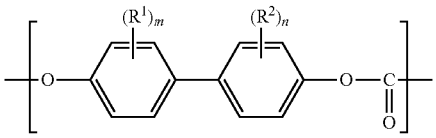

in the general formula (1), $R^1$ and $R^2$ each independently represent a hydrogen atom, a halogen atom, a substituted or unsubstituted alkyl group, or an aryl group, and "m" and "n" each independently represent an integer of 0 or more and 4 or less;

General formula (2)

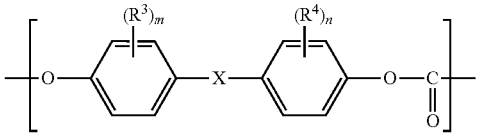

in the general formula (2), $R^3$ and $R^4$ each independently represent a halogen atom, an alkyl group, a cycloalkyl group, or an aryl group, "m" and "n" each independently represent an integer of 0 or more and 4 or less, and X represents a cycloalkylene group, an alkylene group, a phenylene group, a biphenylene group, a naphthylene group, —O—, —S—, —SO—, or $—SO_2—$.

It has heretofore been known that, when a biphenyl copolymerization-type polycarbonate resin is used as a binder resin for the charge-transporting layer of an electrophotographic photosensitive member, the abrasion resistance of the charge-transporting layer is improved, and hence the lifetime of the electrophotographic photosensitive member can be lengthened. However, when image output is repeated by using the electrophotographic photosensitive member containing the biphenyl copolymerization-type polycarbonate resin in its charge-transporting layer, there has occurred a problem in that a ghost image in which an exposure history at the time of the previous rotation of the photosensitive member appears as a density difference occurs at the time of the output of a halftone image.

The inventors have considered a reason for the occurrence of a ghost to be as described below. The biphenyl skeleton of the biphenyl copolymerization-type polycarbonate resin is liable to serve as a charge-trapping site, and hence charge is liable to be accumulated in the charge-transporting layer. The charge accumulated in the charge-transporting layer may cause a reduction in charging potential of the electrophotographic photosensitive member at the time of its next charging after exposure to increase the density of a halftone image, thereby causing a ghost image. In addition, when a state in which charge is hardly injected into a space between the charge-generating layer and charge-transporting layer of the photosensitive member, and a space between the charge-generating layer and undercoat layer thereof is established, the charge is liable to be accumulated in the charge-transporting layer. Accordingly, a ghost image is assumed to significantly occur when image output is repeated.

Further, in recent years, the following approach has been used: the abrasion resistance of the charge-transporting layer is improved by reducing the content of a charge-transporting substance in the charge-transporting layer through an increase in thickness of the charge-transporting layer. However, an increase in thickness of the charge-transporting layer increases the quantity of charge accumulated in the charge-transporting layer. In addition, when the content ratio of the charge-transporting substance is reduced by an increase in thickness of the charge-transporting layer, a distance between the molecules of the charge-transporting substance in the charge-transporting layer extends to inhibit charge transfer, and hence the quantity of charge accumulated in the layer increases. Accordingly, a ghost in the charge-transporting layer may be liable to more significantly occur.

In contrast, the inventors have assumed the reason why the above-mentioned problem can be solved by using an electrophotographic photosensitive member having the following features to be as described below: the undercoat layer of the photosensitive member contains strontium titanate particles and a binder resin; and the charge-generating layer thereof contains a phthalocyanine pigment and a binder resin.

The suppression of a ghost requires the alleviation of the accumulation of charge trapped and retained in the electrophotographic photosensitive member. It is assumed that charge generated at the time of the exposure of the photosensitive member cannot completely transfer to the electroconductive support of the photosensitive member by the time of next charging, and is hence accumulated in the charge-transporting layer, or at an interface between the respective layers, of the photosensitive member to cause a ghost. Accordingly, charge transfer in a low electric field needs to be sufficiently kept. When the electrophotographic photosensitive member contains the phthalocyanine crystal in its charge-generating layer, and contains the strontium titanate particles in its undercoat layer, an electron-conveying property in the undercoat layer may be improved to suppress charge retention at an interface between the charge-generating layer and the undercoat layer. In addition, the charge-generating layer containing the phthalocyanine crystal has high sensitivity, and hence efficiently generates a carrier with respect to photoenergy. Accordingly, carrier trapping in the charge-generating layer is assumed to be suppressed. The inventors have assumed that, as a result of the foregoing, when the photosensitive member is exposed to light, charge is hardly retained at an interface between the charge-generating layer and the charge-transporting layer, and the interface between the charge-generating layer and the undercoat layer. Accordingly, a state in which charge is hardly accumulated in the charge-transporting layer even when image output is repeatedly performed may be established to inhibit the occurrence of a ghost phenomenon. Meanwhile, the undercoat layer is required to have a function of inhibiting the injection of charge from the support into the photosensitive layer of the photosensitive member at the time of the charging of the photosensitive member, in particular, charge injection in a high electric field. The inventors have found that, when the undercoat layer has the strontium titanate particles, a ghost can be suppressed while the inhibition of charge injection from the support in a high electric field is maintained. Thus, the inventors have reached the present disclosure.

The effect of the present disclosure can be achieved when the respective configurations synergistically affect each other like the foregoing mechanism.

[Electrophotographic Photosensitive Member]

The electrophotographic photosensitive member according to one aspect of the present disclosure includes the undercoat layer, the charge-generating layer, and the charge-transporting layer in the stated order on the support.

A method of manufacturing the electrophotographic photosensitive member according to one aspect of the present disclosure is, for example, a method involving: preparing coating liquids for the respective layers to be described later; applying the coating liquids for desired layers in order; and drying the liquids. At this time, a method of applying each of the coating liquids is, for example, dip coating, spray coating, inkjet coating, roll coating, die coating, blade coating, curtain coating, wire bar coating, or ring coating. Of those, dip coating is preferred from the viewpoints of efficiency and productivity. The support and the respective layers are described below.

<Support>

The electrophotographic photosensitive member according to one aspect of the present disclosure includes the support. In the electrophotographic photosensitive member according to one aspect of the present disclosure, the support is preferably an electroconductive support having electroconductivity. In addition, examples of the shape of the support include a cylindrical shape, a belt shape, and a sheet shape. Of those, a cylindrical support is preferred. In addition, the surface of the support may be subjected to, for example, an electrochemical treatment, such as anodization, a blast treatment, or a cutting treatment.

A metal, a resin, a glass, or the like is preferred as a material for the support.

Examples of the metal include aluminum, iron, nickel, copper, gold, and stainless steel, and alloys thereof. Of those, an aluminum support using aluminum is preferred.

In addition, electroconductivity may be imparted to the resin or the glass through a treatment involving, for example, mixing or coating the resin or the glass with an electroconductive material.

<Undercoat Layer>

In one aspect of the present disclosure, the undercoat layer is arranged on the support.

The undercoat layer contains the strontium titanate particles and the binder resin. When the undercoat layer contains the strontium titanate particles, a charge-transporting property in the undercoat layer may become satisfactory to enable the suppression of a ghost. In addition, the arrangement of the undercoat layer can facilitate the coverage of a defect in the support, an improvement in applicability of the photosensitive layer, an improvement in adhesive property between the photosensitive layer and the support, and the inhibition of the injection of charge from the support into the photosensitive layer.

The specific surface area of the strontium titanate particles in the undercoat layer is preferably 30 $m^2/g$ or more. When the specific surface area is 30 $m^2/g$ or more, the area of contact between a charge-generating material and the strontium titanate particles at the interface between the charge-generating layer and the undercoat layer increases, and hence charge injection at the interface between the charge-generating layer and the undercoat layer becomes satisfactory. Accordingly, charge accumulation in the charge-transporting layer is assumed to be reduced to further suppress a ghost phenomenon. The specific surface area of the particles may be measured by a BET method based on nitrogen gas adsorption. A measuring apparatus is, for example, a specific surface area-measuring apparatus Macsorb (manufactured by Mountech Co., Ltd.).

With regard to the particle diameters of the strontium titanate particles, the number-average particle diameter of the primary particles thereof is preferably 10 nm or more and 100 nm or less. As the particle diameters become smaller, the specific surface area may increase to further suppress a ghost phenomenon because of the above-mentioned reason. The number-average particle diameter of the primary particles may be determined by: observing the particles with a transmission electron microscope; and averaging the long diameters of 10 arbitrary particles. A measuring apparatus is, for example, JEM-2800 (manufactured by JEOL Ltd.).

The surfaces of the strontium titanate particles may be treated with a silane coupling agent for improving their dispersibility in the undercoat layer. Examples of the silane coupling agent include 3-aminopropyltriethoxysilane, N-2-(aminoethyl)-3-aminopropyltrimethoxysilane, and N-2-(aminoethyl)-3-aminopropylmethyldimethoxysilane. In addition, vinyltrimethoxysilane, 3-methacryloxypropyl-tris(2-methoxyethoxy)silane, isobutyltrimethoxysilane, trifluoropropylmethoxysilane, and the like may also be used.

Any method may be used as a method for the surface treatment with the silane coupling agent as long as the method is a known method, and the method may be any one of a dry method and a wet method. The amount of the silane coupling agent with respect to the strontium titanate particles is preferably 0.1 mass % or more and 5 mass % or less. When the amount of the silane coupling agent to be used in the surface treatment is adjusted within the range, the specific surface area of the strontium titanate particles can be set within the above-mentioned range.

Examples of the binder resin in the undercoat layer include a polyester resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyamide resin, a polyamide acid resin, a polyimide resin, and a cellulose resin. In addition, the undercoat layer may further contain an electron-transporting substance for the purpose of improving electric characteristics. Examples of the electron-transporting substance include a quinone compound, an imide compound, a benzimidazole compound, a cyclopentadienylidene compound, a fluorenone compound, a xanthone compound, and a benzophenone compound.

In one aspect of the present disclosure, the content of the strontium titanate particles in the undercoat layer is preferably 50 mass % or more and 500 mass % or less, more preferably 100 mass % or more and 500 mass % or less with respect to the binder resin. When the content is set within the range, the electrophotographic photosensitive member according to one aspect of the present disclosure can obtain a ghost-suppressing effect, and the undercoat layer can obtain a sufficient strength.

In addition, the undercoat layer may further contain an additive, such as a silicone oil or resin particles.

The average thickness of the undercoat layer is preferably 0.3 μm or more and 30 μm or less, particularly preferably 0.5 μm or more and 10 μm or less.

The undercoat layer may be formed by: preparing a coating liquid for an undercoat layer containing the above-mentioned respective materials and a solvent; applying the coating liquid onto the support to form a coat of the liquid; and drying and/or curing the coat. Examples of the solvent to be used for the coating liquid include an alcohol-based solvent, a ketone-based solvent, an ether-based solvent, an ester-based solvent, and an aromatic hydrocarbon-based solvent. A dispersion method for dispersing the strontium titanate particles is, for example, a method involving using a paint shaker, a sand mill, a ball mill, or a liquid collision-type high-speed disperser.

<Charge-generating Layer>

The charge-generating layer contains the phthalocyanine crystal and the binder resin.

Crystals having the respective crystal forms of a metal-free phthalocyanine and phthalocyanines each having coordinated thereto, for example, a metal, such as copper, indium, gallium, or titanium, or an oxide, halide, hydroxide, or alkoxide thereof are each used as the phthalocyanine crystal in the charge-generating layer. When the electrophotographic photosensitive member includes the charge-generating layer containing the phthalocyanine crystal on the undercoat layer containing the strontium titanate particles, a charge-injecting property into the undercoat layer may become satisfactory to enable the suppression of a ghost. The phthalocyanine crystal is preferably a titanyl phthalocyanine crystal and a gallium phthalocyanine crystal. Of those, an oxytitanium phthalocyanine crystal, a chlorogallium phthalocyanine crystal, and a hydroxygallium phthalocyanine crystal have higher sensitivity, and hence are more preferred from the viewpoint of electric characteristics.

The content of the phthalocyanine crystal in the charge-generating layer is preferably 40 mass % or more and 85 mass % or less, more preferably 50 mass % or more and 75 mass % or less with respect to the total mass of the charge-generating layer.

Examples of the binder resin in the charge-generating layer include a polyester resin, a polyvinyl acetal resin, a polyvinyl butyral resin, an acrylic resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably 0.1 μm or more and 1 μm or less, more preferably 0.15 μm or more and 0.4 μm or less.

The charge-generating layer may be formed by: preparing a coating liquid for a charge-generating layer containing the above-mentioned respective materials and a solvent; applying the coating liquid onto the undercoat layer to form a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

<Charge-Transporting Layer>

The charge-transporting layer contains the charge-transporting substance and a biphenyl copolymerization-type polycarbonate resin.

A biphenyl copolymerization-type polycarbonate resin having a structural unit represented by the following general formula (1) and a structural unit represented by the following general formula (2) is used as the biphenyl copolymerization-type polycarbonate resin in the charge-transporting layer from the viewpoint of the abrasion resistance of the layer:

General formula (1)

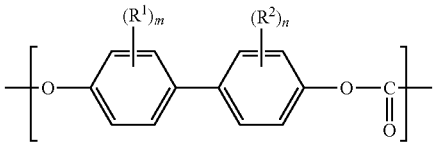

in the general formula (1), $R^1$ and $R^2$ each independently represent a hydrogen atom, a halogen atom, a substituted or unsubstituted alkyl group, or an aryl group, and "m" and "n" each independently represent an integer of 0 or more and 4 or less;

General formula (2)

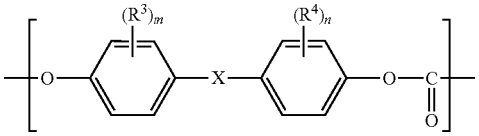

in the general formula (2), $R^3$ and $R^4$ each independently represent a halogen atom, an alkyl group, a cycloalkyl group, or an aryl group, "m" and "n" each independently represent an integer of 0 or more and 4 or less, and X represents a cycloalkylene group, an alkylene group, a phenylene group, a biphenylene group, a naphthylene group, —O—, —S—, —SO—, or —$SO_2$—.

Specific examples of the structural unit represented by the general formula (1) are shown below.

(Formula 1-1)

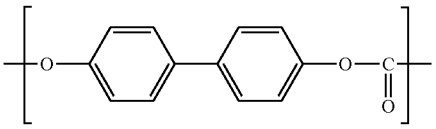

(Formula 1-2)

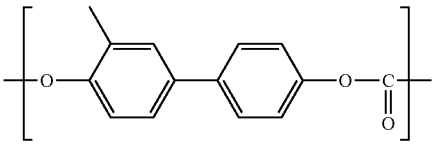

(Formula 1-3)

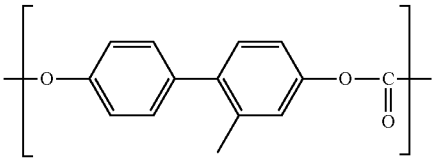

(Formula 1-4)

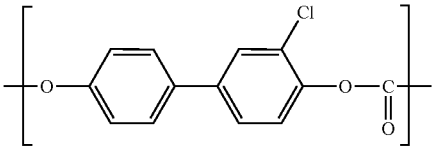

Specific examples of the structural unit represented by the general formula (2) are shown below.

(Formula 2-1)

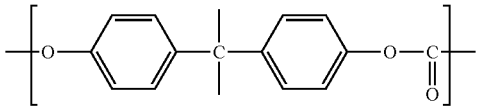

(Formula 2-2)

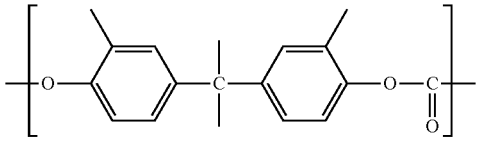

(Formula 2-3)

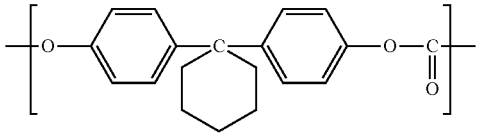

(Formula 2-4)

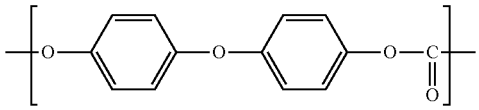

Examples of the charge-transporting substance in the charge-transporting layer include a polycyclic aromatic compound, a heterocyclic compound, a hydrazone compound, a styryl compound, an enamine compound, a benzidine compound, a triarylamine compound, and a butadiene compound. The examples also include resins having groups derived from those substances. Of those, a triarylamine compound, a benzidine compound, and a butadiene compound are preferred. Those charge-transporting substances may be used alone or in any combination thereof.

In the charge-transporting layer, the content of the biphenyl copolymerization-type polycarbonate resin with respect to the charge-transporting substance is preferably 100 mass % or more from the viewpoint of compatibility between the charge-transporting substance and the biphenyl copolymerization-type polycarbonate resin, and is preferably 125 mass % or more from the viewpoint of the abrasion resistance. Further, the content is preferably 250 mass % or less from the viewpoint of reducing the quantity of charge to be trapped in the charge-transporting layer.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, and a benzophenone compound. The examples also include a siloxane-modified resin, a silicone oil, fluorine resin particles, polystyrene resin particles, polyethylene resin particles, silica particles, alumina particles, and boron nitride particles.

The average thickness of the charge-transporting layer is preferably 10 μm or more and 50 μm or less, and is particularly preferably 30 μm or more from the viewpoint of the abrasion resistance. Further, the average thickness is preferably 50 μm or less from the viewpoints of a high resolution of the electrophotographic photosensitive member and the productivity thereof.

The charge-transporting layer may be formed by: preparing a coating liquid for a charge-transporting layer containing the above-mentioned respective materials and a solvent; applying the coating liquid onto the charge-generating layer to form a coat of the liquid; and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

[Process Cartridge and Electrophotographic Apparatus]

A process cartridge according to one aspect of the present disclosure integrally supports the electrophotographic photosensitive member described above, and at least one unit selected from the group consisting of a charging unit, a developing unit, and a cleaning unit, and is removably mounted onto the main body of an electrophotographic apparatus.

In addition, an electrophotographic apparatus according to one aspect of the present disclosure includes the electrophotographic photosensitive member described above, and at least one unit selected from the group consisting of a charging unit, an exposing unit, a developing unit, and a transferring unit.

An example of the schematic construction of an electrophotographic apparatus including a process cartridge including an electrophotographic photosensitive member is illustrated in FIG. 1.

An electrophotographic photosensitive member 1 having a cylindrical shape is rotationally driven at a predetermined peripheral speed in a direction indicated by the arrow about an axis 2 as a center. The surface of the electrophotographic photosensitive member 1 is charged to a predetermined positive or negative potential by a charging unit 3. In FIG. 1, a roller charging system based on a roller-type charging member is illustrated, but a charging system such as a corona charging system, a proximity charging system, or an injection charging system may be adopted. The charged surface of the electrophotographic photosensitive member 1 is irradiated with exposure light 4 from an exposing unit (not shown), and an electrostatic latent image corresponding to target image information is formed thereon. The electrostatic latent image formed on the surface of the electrophotographic photosensitive member 1 is developed with toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to a treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. A cleaner-less system configured to remove the deposit with the developing unit or the like without separate arrangement of the cleaning unit may be used. The electrophotographic apparatus may include an electricity-removing mechanism configured to subject the surface of the electrophotographic photosensitive member 1 to an electricity-removing treatment with pre-exposure light 10 from a pre-exposing unit (not shown). The pre-exposing unit is not necessarily required. In addition, a guiding unit 12, such as a rail, may be arranged for removably mounting a process cartridge 11 according to one aspect of the present disclosure onto the main body of the electrophotographic apparatus.

The electrophotographic photosensitive member according to one aspect of the present disclosure can be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description of the following Examples, "part(s)" is by mass unless otherwise specified.

<Method of producing Surface-treated Strontium Titanate Particles S1A>

A hydrous titanium oxide slurry obtained by hydrolyzing titanyl sulfate was washed with an alkaline aqueous solution. Next, hydrochloric acid was added to the hydrous titanium oxide slurry to adjust its pH to 0.7. Thus, a titania sol-dispersed liquid was obtained.

An aqueous solution containing strontium chloride in a molar amount 1.1 times as large as that of the titania sol of the titania sol-dispersed liquid (containing 2.2 mol of the titania sol in terms of titanium oxide) was added to the dispersed liquid, and the mixture was loaded into a reaction vessel, followed by the purging of air in the vessel with a nitrogen gas. Further, pure water was added to the mixture so that the concentration of the titania sol became 1.1 mol/L in terms of titanium oxide. Next, the materials were stirred and mixed, and the mixture was warmed to 90° C. After that, while ultrasonic vibration was applied to the mixture, 440 mL of a 10 N aqueous solution of sodium hydroxide was added to the mixture over 15 minutes, and then the whole was subjected to a reaction for 20 minutes. Pure water at 5° C. was added to the reaction liquid to rapidly cool the liquid to 30° C. or less, and then the supernatant liquid was removed. Thus, a slurry was obtained. Further, an aqueous solution of hydrochloric acid having a pH of 5.0 was added to the slurry, and the mixture was stirred for 1 hour. After that, the slurry was repeatedly washed with pure water. Further, the slurry was neutralized with an aqueous solution of sodium hydroxide, and was then filtered with Nutsche, followed by washing with pure water. The resultant cake was dried to provide strontium titanate particles S1.

100 Parts of the strontium titanate particles S1 and 500 parts of toluene were stirred and mixed, and 0.5 part of N-2-(aminoethyl)-3-aminopropyltrimethoxysilane was added as a silane coupling agent to the mixture, followed by stirring for 6 hours. After that, toluene was removed under reduced pressure, and the residue was heated and dried at 130° C. for 6 hours. Thus, surface-treated strontium titanate particles S1A were obtained. The strontium titanate particles S1A had a number-average particle diameter of primary particles of 35 nm and a specific surface area of 63 $m^2/g$.

<Method of Producing Surface-Treated Strontium Titanate Particles S2A>

The titania sol-dispersed liquid described in the method of producing the strontium titanate particles S1 was adjusted to a dispersed liquid containing 2.6 mol of titania sol in terms of titanium oxide. An aqueous solution containing strontium chloride in a molar amount 1.0 times as large as that of the titania sol of the dispersed liquid was added to the dispersed liquid, and the mixture was loaded into a reaction vessel, followed by the purging of air in the vessel with a nitrogen gas. Further, pure water was added to the mixture so that the concentration of the titania sol became 1.3 mol/L in terms of titanium oxide. Next, the materials were stirred and mixed, and the mixture was warmed to 95° C. After that, while ultrasonic vibration was applied to the mixture, 300 mL of a 15 N aqueous solution of sodium hydroxide was added to the mixture over 5 minutes, and then the whole was subjected to a reaction for 20 minutes. Pure water at 5° C. was added to the reaction liquid to rapidly cool the liquid to 30° C. or less, and then the supernatant liquid was removed. Thus, a slurry was obtained. Further, an aqueous solution of hydrochloric acid having a pH of 5.0 was added to the slurry, and the mixture was stirred for 1 hour. After that, the slurry was repeatedly washed with pure water. Further, the slurry was neutralized with an aqueous solution of sodium hydroxide, and was then filtered with Nutsche, followed by washing with pure water. The resultant cake was dried to provide strontium titanate particles S2.

100 Parts of the strontium titanate particles S2 and 500 parts of toluene were stirred and mixed, and 0.5 part of N-2-(aminoethyl)-3-aminopropyltrimethoxysilane was added as a silane coupling agent to the mixture, followed by stirring for 6 hours. After that, toluene was removed under reduced pressure, and the residue was heated and dried at 130° C. for 6 hours. Thus, surface-treated strontium titanate particles S2A were obtained. The strontium titanate particles S2A had a number-average particle diameter of primary particles of 10 nm and a specific surface area of 85 $m^2/g$.

<Methods of Producing Strontium Titanate Particles S3 and Surface-Treated Strontium Titanate Particles S3A>

The titania sol-dispersed liquid described in the method of producing the strontium titanate particles S1 was adjusted to a dispersed liquid containing 0.6 mol of titania sol in terms of titanium oxide. An aqueous solution containing strontium chloride in a molar amount 1.2 times as large as that of the titania sol of the dispersed liquid was added to the dispersed liquid, and the mixture was loaded into a reaction vessel, followed by the purging of air in the vessel with a nitrogen gas. Further, pure water was added to the mixture so that the concentration of the titania sol became 0.3 mol/L in terms of titanium oxide.

Next, the materials were stirred and mixed, and the mixture was warmed to 80° C. After that, while ultrasonic vibration was applied to the mixture, 750 mL of a 2 N aqueous solution of sodium hydroxide was added to the mixture over 480 minutes, and then the whole was subjected to a reaction for 20 minutes.

Pure water at 5° C. was added to the reaction liquid to rapidly cool the liquid to 30° C. or less, and then the supernatant liquid was removed. Thus, a slurry was obtained. Further, the slurry was washed with pure water. The resultant cake was dried to provide strontium titanate particles S3. The strontium titanate particles S3 had a number-average particle diameter of 100 nm and a specific surface area of 30 $m^2/g$.

100 Parts of the strontium titanate particles S3 and 500 parts of toluene were stirred and mixed, and 0.5 part of N-2-(aminoethyl)-3-aminopropyltrimethoxysilane was added as a silane coupling agent to the mixture, followed by stirring for 6 hours. After that, toluene was removed under reduced pressure, and the residue was heated and dried at 130° C. for 6 hours. Thus, surface-treated strontium titanate particles S3A were obtained. The strontium titanate particles S3A had a number-average particle diameter of primary particles of 100 nm and a specific surface area of 28 $m^2/g$.

<Method of Producing Surface-Treated Strontium Titanate Particles S4A>

The titania sol-dispersed liquid described in the method of producing the strontium titanate particles S1 was adjusted to a dispersed liquid containing 0.6 mol of titania sol in terms of titanium oxide. An aqueous solution containing strontium chloride in a molar amount 1.2 times as large as that of the titania sol of the dispersed liquid was added to the dispersed liquid, and the mixture was loaded into a reaction vessel, followed by the purging of air in the vessel with a nitrogen gas. Further, 0.05 mol of aluminum sulfate was added to the mixture, and then pure water was added thereto so that the concentration of the titania sol became 0.3 mol/L in terms of titanium oxide. Next, the materials were stirred and mixed, and the mixture was warmed to 80° C. After that, while ultrasonic vibration was applied to the mixture, 450 mL of a 2 N aqueous solution of sodium hydroxide was added to the mixture over 5 minutes, and then the whole was subjected to a reaction for 20 minutes.

Pure water at 5° C. was added to the reaction liquid to rapidly cool the liquid to 30° C. or less, and then the supernatant liquid was removed. Thus, a slurry was obtained. Further, the slurry was washed with pure water. The resultant cake was dried to provide strontium titanate particles S4.

100 Parts of the strontium titanate particles S4 and 500 parts of toluene were stirred and mixed, and 0.5 part of N-2-(aminoethyl)-3-aminopropyltrimethoxysilane was added as a silane coupling agent to the mixture, followed by stirring for 6 hours. After that, toluene was removed under reduced pressure, and the residue was heated and dried at 130° C. for 6 hours. Thus, surface-treated strontium titanate particles S4A were obtained. The strontium titanate particles S4A had a number-average particle diameter of primary particles of 110 nm and a specific surface area of 23 $m^2/g$.

Example 1

An aluminum cylinder having a length of 357.5 mm, a thickness of 0.7 mm, and an outer diameter of 30 mm was prepared as a support (electroconductive support). The surface of the prepared aluminum cylinder was subjected to cutting with a lathe. Cutting conditions were as follows: the surface was processed with a bite having a radius of curvature R of 0.1 mm at a main shaft revolution number of 10,000 rpm while a bite-feeding speed was continuously changed in the range of from 0.03 mm/rpm to 0.06 mm/rpm.

Next, 15 parts of a butyral resin (product name: BM-1, manufactured by Sekisui Chemical Co., Ltd.) and 15 parts of a blocked isocyanate (product name: SUMIDUR 3175, manufactured by Sumika Bayer Urethane Co., Ltd.) were dissolved in 250 parts of methyl ethyl ketone and 250 parts of 1-butanol. 60 Parts of the strontium titanate particles S1A were added to the mixed liquid. The particles were dispersed in the mixed liquid with a sand mill apparatus using glass beads each having a diameter of 0.8 mm under an atmosphere at 23° C. for 3 hours. Thus, a coating liquid for an undercoat layer was obtained. The resultant coating liquid for an undercoat layer was applied onto the support by dip coating, and was dried for 30 minutes at 160° C. to form an undercoat layer having a thickness of 2.0 μm.

Next, 10 parts of a polyvinyl butyral resin (product name: S-LEC BX-1, manufactured by Sekisui Chemical Co., Ltd.) was dissolved in 600 parts of cyclohexanone. 15 Parts of an oxytitanium phthalocyanine crystal (Formula 3) of a crystal form having a strong peak at Bragg angles 20±0.2° in CuKα characteristic X-ray diffraction of 27.3° serving as a charge-generating substance was added to the liquid. The resultant was loaded into a sand mill using glass beads having a diameter of 1 mm, and was subjected to a dispersion treatment for 4 hours, followed by the addition of 600 parts of ethyl acetate. Thus, a coating liquid for a charge-generating layer was prepared. The coating liquid for a charge-generating layer was applied onto the undercoat layer by dip coating, and the resultant coat was dried for 15 minutes at 80° C. to form a charge-generating layer having a thickness of 0.20 μm.

Formula 3

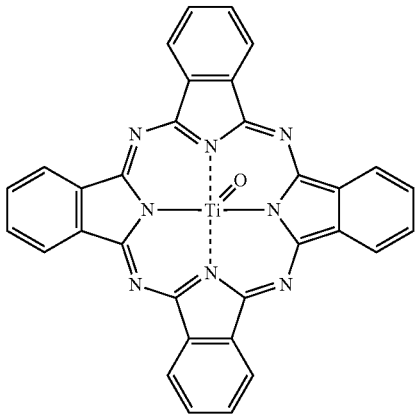

Next, 60 parts of a compound (charge-transporting substance) represented by Formula 4, and 75 parts of a biphenyl copolymerization-type polycarbonate resin (PC-1, weight-average molecular weight: 40,000) having the structural unit represented by (Formula 1-1) and the structural unit represented by (Formula 2-3) at a mass ratio of 3:7 were dissolved in a mixed solvent of 340 parts of o-xylene and 200 parts of tetrahydrofuran. Thus, a coating liquid for a charge-transporting layer was prepared.

The coating liquid for a charge-transporting layer was applied onto the charge-generating layer by dip coating to form a coat, and the resultant coat was dried for 60 minutes at 120° C. to form a charge-transporting layer having a thickness of 30 μm.

Formula 4

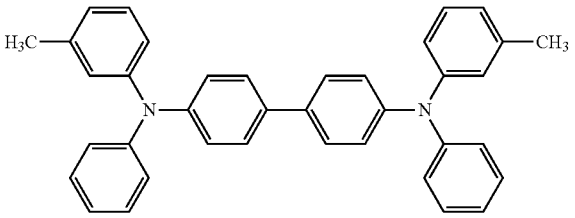

Thus, an electrophotographic photosensitive member of Example 1 was produced.

[Evaluation of Electrophotographic Photosensitive Member]

A reconstructed machine of a copying machine iR C3380 manufactured by Canon Inc. was used as an electrophotographic apparatus for an evaluation.

Figure 2:
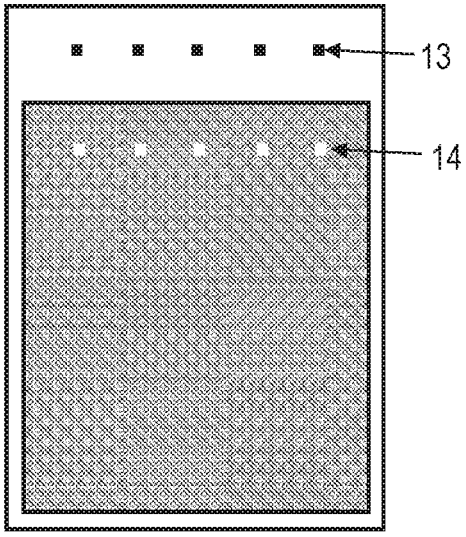
FIG. 2 is a view for illustrating a method of measuring a difference in density between a ghost portion and a non-ghost portion in a halftone portion in the durability evaluation of the electrophotographic photosensitive member according to one aspect of the present disclosure.

In an environment having a temperature of 23° C. and a humidity of 50% RH, a printing job in which an image having a print percentage of 5% was continuously output on 5 sheets was repeated 10,000 times. After that, an image (FIG. 2) having 1-centimeter square solid black patch portions 13 in the first round of the electrophotographic photosensitive member and having a halftone portion in each of the second and subsequent rounds thereof was continuously output on 10 sheets, and a difference between the densities of each of ghost portions 14 and a non-ghost portion in the halftone portion was measured. The densities were measured with a spectro-densitometer X-Rite 504 (manufactured by X-Rite, Incorporated).

Further, as an abrasion resistance evaluation, a reduction in density between halftone images (HT images) at an initial stage and after endurance, and the presence or absence of a halftone image defect due to a flaw after the endurance were observed. The endurance was such that, in an environment having a temperature of 23° C. and a humidity of 50% RH, a printing job in which an image having a print percentage of 5% was continuously output on 5 sheets was repeated 10,000 times. As the shaved amount of the charge-transporting layer increases, a change in density between the HT images becomes larger. As an evaluation method, a HT image was formed at the initial stage so as to have a density of 0.5, and in the same charging, exposure, development, and transfer settings as those at the initial stage, a HT image was formed after the endurance. The densities of the resultant HT images were measured, and a reduction in image density between the images was evaluated by the following evaluation criteria. The results are shown in Table 1.

<Abrasion Resistance Evaluation Criteria>

A: The reduction in image density is 0.1 or less.

B: The reduction in image density is 0.11 or more and less than 0.20.

C: The reduction in image density is 0.20 or more.

D: A stripe-like image defect is present.

Example 2

In Example 1, the charge-generating substance was changed to a hydroxygallium phthalocyanine crystal (Formula 5) of a crystal form having strong peaks at Bragg angles 2θ±0.2° in CuKα characteristic X-ray diffraction of 7.3°, 16.0°, 24.9°, and 28.0°. An electrophotographic photosensitive member was produced and evaluated in the same manner as in Example 1 except the foregoing. The results are shown in Table 1.

Formula 5

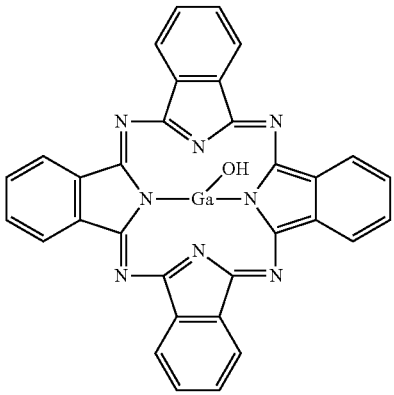

Example 3

In the charge-transporting layer of Example 1, the biphenyl copolymerization-type polycarbonate resin was changed to a biphenyl copolymerization-type polycarbonate resin (PC-2, weight-average molecular weight: 50,000) having the structural unit represented by (Formula 1-1) and the structural unit represented by (Formula 2-2) at a mass ratio of 4:6. An electrophotographic photosensitive member was produced and evaluated in the same manner as in Example 1 except the foregoing. The results are shown in Table 1.

Example 4

An electrophotographic photosensitive member was produced and evaluated in the same manner as in Example 1 except that, in the undercoat layer of Example 1, the strontium titanate particles were changed to the strontium titanate particles S2A. The results are shown in Table 1.

Example 5

An electrophotographic photosensitive member was produced and evaluated in the same manner as in Example 1 except that, in the undercoat layer of Example 1, the strontium titanate particles were changed to the strontium titanate particles S3. The results are shown in Table 1.

Example 6

An electrophotographic photosensitive member was produced and evaluated in the same manner as in Example 1 except that, in the undercoat layer of Example 1, the strontium titanate particles were changed to the strontium titanate particles S4A. The results are shown in Table 1.

Example 7

An electrophotographic photosensitive member was produced and evaluated in the same manner as in Example 1 except that, in the undercoat layer of Example 1, the strontium titanate particles were changed to the strontium titanate particles S3A. The results are shown in Table 1.

Example 8

An electrophotographic photosensitive member was produced and evaluated in the same manner as in Example 7 except that, in Example 7, the amount of the strontium titanate particles used in the undercoat layer was changed to 150 parts. The results are shown in Table 1.

Example 9

An electrophotographic photosensitive member was produced and evaluated in the same manner as in Example 7 except that, in Example 7, the amount of the strontium titanate particles used in the undercoat layer was changed to 30 parts. The results are shown in Table 1.

Example 10

An electrophotographic photosensitive member was produced and evaluated in the same manner as in Example 7 except that, in Example 7, the amount of the strontium titanate particles used in the undercoat layer was changed to 27 parts. The results are shown in Table 1.

Example 11

An electrophotographic photosensitive member was produced and evaluated in the same manner as in Example 10 except that, in Example 10, the amount of the charge-transporting substance used in the charge-transporting layer was changed to 30 parts. The results are shown in Table 1.

Example 12

An electrophotographic photosensitive member was produced and evaluated in the same manner as in Example 10 except that, in Example 10, the thickness of the charge-transporting layer was changed to 40 μm. The results are shown in Table 1.

Example 13

An electrophotographic photosensitive member was produced and evaluated in the same manner as in Example 10 except that, in Example 10, the amount of the charge-transporting substance used in the charge-transporting layer was changed to 25 parts. The results are shown in Table 1.

Example 14

An electrophotographic photosensitive member was produced and evaluated in the same manner as in Example 10 except that, in Example 10, the amount of the charge-transporting substance used in the charge-transporting layer was changed to 60 parts. The results are shown in Table 1.

Example 15

An electrophotographic photosensitive member was produced and evaluated in the same manner as in Example 14 except that, in Example 14, the thickness of the charge-transporting layer was changed to 25 μm. The results are shown in Table 1.

Comparative Example 1

An electrophotographic photosensitive member was produced and evaluated in the same manner as in Example 1 except that, in Example 1, no strontium titanate particles were used in the undercoat layer. The results are shown in Table 1.

Comparative Example 2

An electrophotographic photosensitive member was produced and evaluated in the same manner as in Example 11 except that, in Example 11, the charge-generating substance was changed to an azo pigment (Formula 6) having the following structure. The results are shown in Table 1.

Formula 6

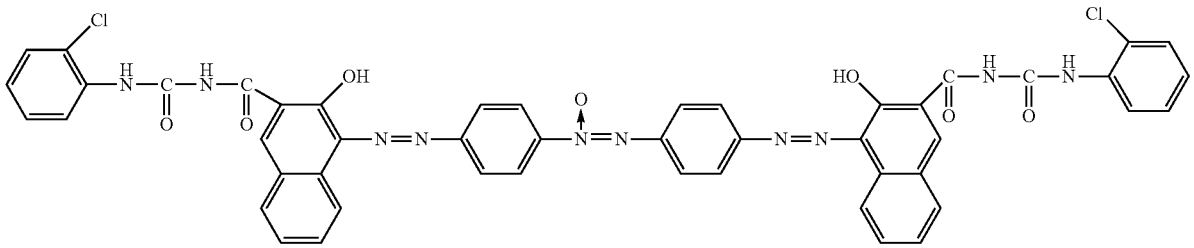

Comparative Example 3

An electrophotographic photosensitive member was produced and evaluated in the same manner as in Example 11 except that, in Example 11, the strontium titanate particles of the undercoat layer were changed to titanium oxide particles (product name: TTO-55, manufactured by Ishihara Sangyo Kaisha, Ltd., number-average particle diameter of primary particles: 40 nm, specific surface area: 40 $m^2/g$). The results are shown in Table 1.

Comparative Example 4

An electrophotographic photosensitive member was produced and evaluated in the same manner as in Example 11 except that, in Example 11, the strontium titanate particles of the undercoat layer were changed to zinc oxide particles (product name: MZ300, manufactured by Tayca Corporation, number-average particle diameter of primary particles: 70 nm, specific surface area: 15 $m^2/g$). The results are shown in Table 1.

Comparative Example 5

An electrophotographic photosensitive member was produced and evaluated in the same manner as in Example 15 except that, in Example 15, the strontium titanate particles of the undercoat layer were changed to titanium oxide particles (product name: TTO-55, manufactured by Ishihara Sangyo Kaisha, Ltd.), and the biphenyl copolymerization-type polycarbonate resin of the charge-transporting layer was changed to a homopolymerization-type polycarbonate resin of bisphenol Z (PC-3, weight-average molecular weight: 40,000). The results are shown in Table 1.

TABLE 1

| | Photosensitive member configuration | | | | | | | |
|---|---|---|---|---|---|---|---|---|
| | Undercoat layer | | | Charge-transporting layer | | | | |
| | Metal oxide | | Charge-generating layer | Binder resin | | | Evaluation | |
| | Kind | Content ratio (mass %) | Charge-generating substance | Kind | Content ratio (mass %) | Thickness (μm) | Ghost density difference | Durability |
| Example 1 | S1A | 200% | Oxytitanium phthalocyanine | PC-1 | 125% | 30 μm | 0.007 | A |
| Example 2 | S1A | 200% | Hydroxygallium phthalocyanine | PC-1 | 125% | 30 μm | 0.006 | A |
| Example 3 | S1A | 200% | Oxytitanium phthalocyanine | PC-2 | 125% | 30 μm | 0.008 | A |
| Example 4 | S2A | 200% | Oxytitanium phthalocyanine | PC-1 | 125% | 30 μm | 0.005 | A |
| Example 5 | S3 | 200% | Oxytitanium phthalocyanine | PC-1 | 125% | 30 μm | 0.010 | A |
| Example 6 | S4A | 200% | Oxytitanium phthalocyanine | PC-1 | 125% | 30 μm | 0.018 | A |
| Example 7 | S3A | 200% | Oxytitanium phthalocyanine | PC-1 | 125% | 30 μm | 0.013 | A |
| Example 8 | S3A | 500% | Oxytitanium phthalocyanine | PC-1 | 125% | 30 μm | 0.008 | A |
| Example 9 | S3A | 100% | Oxytitanium phthalocyanine | PC-1 | 125% | 30 μm | 0.015 | A |
| Example 10 | S3A | 90% | Oxytitanium phthalocyanine | PC-1 | 125% | 30 μm | 0.018 | A |
| Example 11 | S3A | 90% | Oxytitanium phthalocyanine | PC-1 | 250% | 30 μm | 0.020 | A |
| Example 12 | S3A | 90% | Oxytitanium phthalocyanine | PC-1 | 125% | 40 μm | 0.022 | A |
| Example 13 | S3A | 90% | Oxytitanium phthalocyanine | PC-1 | 300% | 30 μm | 0.025 | A |
| Example 14 | S3A | 90% | Oxytitanium phthalocyanine | PC-1 | 100% | 30 μm | 0.013 | B |
| Example 15 | S3A | 90% | Oxytitanium phthalocyanine | PC-1 | 100% | 25 μm | 0.010 | C |
| Comparative Example 1 | None | — | Oxytitanium phthalocyanine | PC-1 | 125% | 30 μm | 0.043 | A |
| Comparative Example 2 | S3A | 90% | Azo pigment | PC-1 | 250% | 30 μm | 0.033 | A |
| Comparative Example 3 | Titanium oxide | 90% | Oxytitanium phthalocyanine | PC-1 | 250% | 30 μm | 0.036 | A |
| Comparative Example 4 | Zinc oxide | 90% | Oxytitanium phthalocyanine | PC-1 | 250% | 30 μm | 0.035 | A |
| Comparative Example 5 | Titanium oxide | 90% | Oxytitanium phthalocyanine | PC-3 | 100% | 25 μm | 0.020 | D |

As shown in Table 1, the electrophotographic photosensitive member, the process cartridge, and the electrophotographic apparatus according to one aspect of the present disclosure can each achieve both of abrasion resistance and the suppression of a ghost.

As described above by way of the embodiments and Examples, according to one aspect of the present disclosure, the electrophotographic photosensitive member that can achieve both of an improvement in abrasion resistance and the suppression of a ghost phenomenon can be provided. In addition, according to one aspect of the present disclosure, the electrophotographic apparatus and the process cartridge each including the electrophotographic photosensitive member can be provided.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-201289, filed Oct. 25, 2018, which is hereby incorporated by reference herein in its entirety.

What is claimed is:

1. An electrophotographic photosensitive member comprising, in this order:

a support;

an undercoat layer comprising strontium titanate particles and a binder resin;

a charge-generating layer comprising a phthalocyanine crystal and a binder resin; and a charge-transporting layer, wherein the charge-transporting layer includes a charge-transporting substance, and a copolymer containing a structure represented by formula (1) and a structure represented by formula (2)

(1)

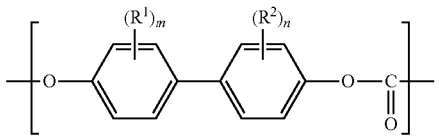

(2)

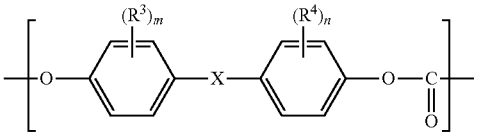

where $R^1$ and $R^2$ independently represent a hydrogen atom, a halogen atom, a substituted or unsubstituted alkyl group or an aryl group, $R^3$ and $R^4$ independently represent a halogen atom, an alkyl group, a cycloalkyl group or an aryl group, m and n independently represent an integer of 0 to 4, and X represents a cycloalkylene group, an alkylene group, a phenylene group, a biphenylene group, a naphthylene group, —O—, —S—, —SO— or —$SO_2$—.

2. The electrophotographic photosensitive member according to claim 1, wherein the charge-transporting layer has a thickness of 30 μm or more.

3. The electrophotographic photosensitive member according to claim 1, wherein a content of the copolymer in the charge-transporting layer is 125 to 250 mass % with respect to a content of the charge-transporting sub stance.

4. The electrophotographic photosensitive member according to claim 1, wherein the phthalocyanine crystal comprises one of a gallium phthalocyanine crystal and a titanyl phthalocyanine crystal.

5. The electrophotographic photosensitive member according to claim 1, wherein a content of the strontium titanate particles in the undercoat layer is 100 to 500 mass % with respect to a content of the binder resin.

6. The electrophotographic photosensitive member according to claim 1, wherein the strontium titanate particles have a specific surface area of 30 $m^2/g$ or more.

7. The electrophotographic photosensitive member according to claim 6, wherein primary particles of the strontium titanate particles have a number-average particle diameter of 10 to 100 nm.

8. The electrophotographic photosensitive member according to claim 6, wherein the strontium titanate particles are subjected to a surface treatment with a silane coupling agent.

9. The electrophotographic photosensitive member according to claim 1, wherein the copolymer contains the structure represented by formula (1) and the structure represented by formula (2) at a mass ratio of 3:7 to 4:6.

10. A process cartridge comprising:

an electrophotographic photosensitive member; and at least one unit selected from the group consisting of a charging unit, a developing unit and a cleaning unit, the process cartridge integrally supporting the electrophotographic photosensitive member and the at least one unit, and being removably mounted onto a main body of an electrophotographic apparatus, the electrophotographic photosensitive member comprising in this order:

a support;

an undercoat layer comprising strontium titanate particles and a binder resin;

a charge-generating layer comprising a phthalocyanine crystal and a binder resin; and a charge-transporting layer, wherein the charge-transporting layer includes a charge-transporting substance, and a copolymer containing a structure represented by formula (1) and a structure represented by formula (2)

(1)

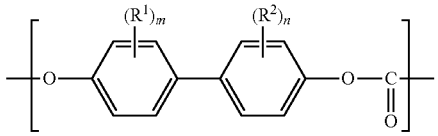

(2)

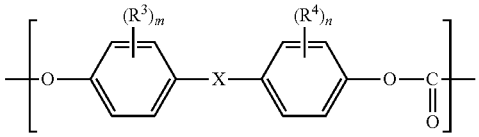

where $R^1$ and $R^2$ independently represent a hydrogen atom, a halogen atom, a substituted or unsubstituted alkyl group or an aryl group, $R^3$ and $R^4$ independently represent a halogen atom, an alkyl group, a cycloalkyl group or an aryl group, m and n independently represent an integer of 0 to 4, and X represents a cycloalkylene group, an alkylene group, a phenylene group, a biphenylene group, a naphthylene group, —O—, —S—, —SO— or —$SO_2$—.

11. The process cartridge according to claim 10, wherein the copolymer contains the structure represented by formula (1) and the structure represented by formula (2) at a mass ratio of 3:7 to 4:6.

12. An electrophotographic apparatus comprising:

an electrophotographic photosensitive member; and at least one unit selected from the group consisting of a charging unit, an exposing unit, a developing unit and a transferring unit, the electrophotographic photosensitive member comprising in this order:

a support;

an undercoat layer comprising strontium titanate particles and a binder resin;

a charge-generating layer comprising a phthalocyanine crystal and a binder resin; and a charge-transporting layer, wherein the charge-transporting layer includes a charge-transporting substance, and a polymer copolymer containing a structure represented by formula (1) and a structure represented by formula (2)

(1)

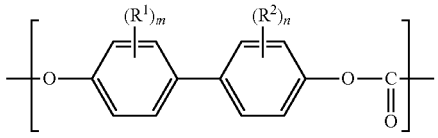

(2)

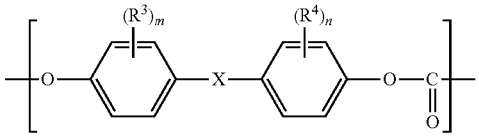

where $R^1$ and $R^2$ independently represent a hydrogen atom, a halogen atom, a substituted or unsubstituted alkyl group or an aryl group, $R^3$ and $R^4$ independently represent a halogen atom, an alkyl group, a cycloalkyl group or an aryl group, m and n independently represent an integer of 0 to 4, and X represents a cycloalkylene group, an alkylene group, a phenylene group, a biphenylene group, a naphthylene group, —O—, —S—, —SO— or —$SO_2$—.

13. The electrophotographic apparatus according to claim 12, wherein the copolymer contains the structure represented by formula (1) and the structure represented by formula (2) at a mass ratio of 3:7 to 4:6.

* * * * *